US009670642B2

(12) United States Patent
Pesch et al.

(10) Patent No.: US 9,670,642 B2
(45) Date of Patent: Jun. 6, 2017

(54) COUPLER FOR COUPLING ATTACHMENTS TO EXCAVATION MACHINES

(71) Applicant: Norm Engineering Pty Ltd., Sumner Park, QLD (AU)

(72) Inventors: John Pesch, New Beith (AU); Norman Pesch, Mount Ommaney (AU); Jeremy Philip Ramsden, Darra (AU); Adam Lauritz Christensen, Camira (AU)

(73) Assignee: Norm Engineering Pty Ltd, Sumner Park, QLD (AU)

( * ) Notice: Subject to any disclaimer, the term of this patent is extended or adjusted under 35 U.S.C. 154(b) by 70 days.

(21) Appl. No.: 14/788,910

(22) Filed: Jul. 1, 2015

(65) Prior Publication Data

US 2016/0002877 A1 Jan. 7, 2016

(30) Foreign Application Priority Data

Jul. 3, 2014 (AU) ..... 2014203664

(51) Int. Cl.
*E02F 3/36* (2006.01)

(52) U.S. Cl.
CPC ..... *E02F 3/3622* (2013.01); *E02F 3/365* (2013.01); *E02F 3/3618* (2013.01); *E02F 3/3663* (2013.01); *E02F 3/3677* (2013.01)

(58) Field of Classification Search
CPC ..... E02F 3/3618; E02F 3/3622; E02F 3/365; E02F 3/3663; E02F 3/3627; E02F 3/3677
See application file for complete search history.

(56) References Cited

U.S. PATENT DOCUMENTS 5,179,794 A * 1/1993 Ballinger ..... E02F 3/3622 172/272
5,242,258 A 9/1993 Weyer
6,718,663 B1 * 4/2004 Geraghty ..... E02F 3/3618 37/443
6,964,122 B2 * 11/2005 Cunningham ..... E02F 3/3618 37/468
7,426,796 B2 9/2008 Cunningham et al.
(Continued)

FOREIGN PATENT DOCUMENTS

WO 2014098616 6/2014

*Primary Examiner* — Jamie L McGowan
(74) *Attorney, Agent, or Firm* — Stephen T. Scherrer; Monique A. Momeault; Scherrer Patent & Trademark Law, P.C.

(57) ABSTRACT

A quick coupler for coupling an attachment, such as a digging bucket, to an evacuator machine. The quick coupler includes a first fixed jaw for a first coupling pin of the attachment. The quick coupler includes a latch cooperating with the first fixed jaw, which is moveable to a latched position for retaining the first coupling pin. A moveable jaw is provided that is able to slide, under power of a hydraulic ram, to a closed position retaining the second coupling pin. A locking arm assumes a locked position, while the latch assumes the latched position, preventing withdrawal of the moveable jaw from the closed position. Consequently, in the event of a hydraulic failure the locking arm simultaneously locks both the first attachment coupling pin, by means of the latch, and the second attachment coupling pin by means of preventing movement of the movable jaw from the closed position.

16 Claims, 7 Drawing Sheets

(56) References Cited

U.S. PATENT DOCUMENTS

| | | | | |
|---|---|---|---|---|
| 7,648,305 | B2 * | 1/2010 | Beales | E02F 3/3618 172/272 |
| 8,556,534 | B2 * | 10/2013 | Lim | E02F 3/3618 37/468 |
| 8,782,931 | B2 * | 7/2014 | Balemi | E02F 3/3618 37/468 |
| 8,974,137 | B2 * | 3/2015 | Parker | 37/468 |
| 2003/0154636 | A1 * | 8/2003 | Miller | E02F 3/3618 37/468 |
| 2003/0204972 | A1 * | 11/2003 | Cunningham | E02F 3/3618 37/403 |
| 2004/0057784 | A1 * | 3/2004 | Geraghty | E02F 3/3618 403/322.3 |
| 2009/0282712 | A1 * | 11/2009 | Pruszynski | E02F 3/3618 37/468 |
| 2010/0061799 | A1 * | 3/2010 | Hill | E02F 3/3645 403/322.3 |
| 2010/0124453 | A1 | 5/2010 | Sikorski et al. | |
| 2011/0209608 | A1 * | 9/2011 | Stefek | E02F 3/3618 91/420 |
| 2013/0160268 | A1 * | 6/2013 | Parker | E02F 3/3618 29/428 |
| 2013/0234415 | A1 * | 9/2013 | Essex | E02F 3/3618 280/504 |

* cited by examiner

COUPLER FOR COUPLING ATTACHMENTS TO EXCAVATION MACHINES

The present application claims priority from Australian patent application No. 2014203664 filed 3 Jul. 2014 and granted 5 Feb. 2015, the content of which is hereby incorporated in it is entirety.

TECHNICAL FIELD

The present invention relates to a hydraulic, quick coupler for coupling an attachment, such as a bucket, to a machine such as an excavator.

BACKGROUND

Any references to methods, apparatus or documents of the prior art are not to be taken as constituting any evidence or admission that they formed, or form part of the common general knowledge.

FIG. 1, depicts an earth moving machine 1. The earth moving machine 1 includes a dipper arm 3. A remote end of the dipper arm 3 is attached to a bucket attachment 5 by means of a quick coupler 7. The quick coupler 7 has a dipper side which mounts to the dipper arm 3 by means of first and second dipper coupling pins 9, 11. It also has an attachment side which includes jaws that engage first and second attachment coupling pins 13, 15. As is known in the prior art the locking of the quick coupler's jaws to at least one of the first and second attachment coupling pins 13, 15 is effected remotely from the cabin of the machine 1 by virtue of a hydraulic circuit that extends from controls in the cabin to one or more actuators of the coupler.

U.S. Pat. No. 6,964,122 describes a prior art quick coupler which includes a hydraulically operated moveable jaw that operates to capture the first attachment coupling pin and a latch mechanism that cooperates with a fixed jaw to capture the second attachment coupling pin. The quick coupler that is described in the '122 patent is explained to have the advantage of the latch continuing to retain the second attachment pin even if, due to a hydraulic circuit failure, the moveable jaw disengages from the first attachment coupling pin.

The quick coupler of the '122 patent and other similar quick couplers of the prior art manage to hold onto the bucket attachment by one pin in the event of a hydraulic failure. Consequently, the bucket attachment 5 does not fall from the dipper arm 3. Nevertheless the bucket attachment will swing rapidly and unexpectedly around the second attachment pin and may pose a serious threat of injury or even death to workers in the area.

It is an object of the present invention to provide an improved quick coupler which addresses or at least ameliorates the above described problem of the prior art.

SUMMARY OF THE INVENTION

According to a first aspect of the present invention there is provided a quick coupler for coupling an attachment to a machine, the attachment having first and second coupling pins, the quick coupler including: a first fixed jaw for the first coupling pin, a moveable jaw moveable to a closed position for retaining the second coupling pin, a locking arm arranged to assume a locked position in which the arm prevents withdrawal of the moveable jaw from the closed position, a latch cooperating with the first fixed jaw and moveable to a latched position for retaining the first coupling pin the latch being fast with the locking arm and arranged to assume the latched position upon the locking arm assuming the locked position, and an actuator coupled to the locking arm and arranged to move the movable jaw, whereby operation of the actuator brings the jaw to the closed position and the arm to the locked position thereby preventing withdrawal of the jaw from the closed position while also bringing the latch to the latched position.

Preferably the locking arm is pivoted at one end for pivoting to the locked position.

In a preferred embodiment of the invention the locking arm and the movable jaw have complementary engagement formations which engage upon the locking arm assuming the locked position and the movable jaw assuming the closed position.

Preferably the complementary engagement formations comprise an angled cutout of the locking arm and a complementary corner of the movable jaw.

The quick coupler may include a biasing means to bias the locking arm to the locked position.

Preferably the locking arm includes a closed cam follower.

In a preferred embodiment of the present invention the closed cam follower follows a translation cam coupled to the actuator.

The translation cam may comprise a trunnion.

Preferably the actuator comprises a linear actuator and the trunnion is coupled to shaft of the linear actuator.

The linear actuator may comprise a hydraulic ram.

The trunnion may comprise a portion of a locking collar.

It is preferred that the movable jaw slides on guides formed on inner sides of a body of the quick coupler.

In a preferred embodiment of the invention the movable jaw is moved to the closed position by means of the linear actuator.

Preferably a resilient spacer is located between the translation cam and the movable jaw whereby upon the movable jaw reaching the closed position the resilient spacer is compressed to thereby allow the translation cam to progress in the closed cam follower to thereby bring the locking arm to the locked position.

For example, the resilient spacer may comprise a coil spring.

It is preferred that the quick coupler includes a second fixed jaw positioned to engage the second attachment coupler pin upon failure of the movable jaw while the first attachment coupler pin is retained by the latch and the first fixed jaw to thereby prevent swinging of the attachment.

The second fixed jaw may oppose the movable jaw.

A rotary actuator may be disposed between coupling points of the coupler for attachment to the machine and the first fixed jaw and the movable jaw whereby operation of the rotary actuator tilts the jaws relative to the coupling points. The coupling points for attachment to the machine typically comprised bushed bores for receiving coupling pins of the machine.

Additional features and advantages of the present invention are described in, and will be apparent from, the detailed description of the presently preferred embodiments and from the drawings.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION

Figure 1:
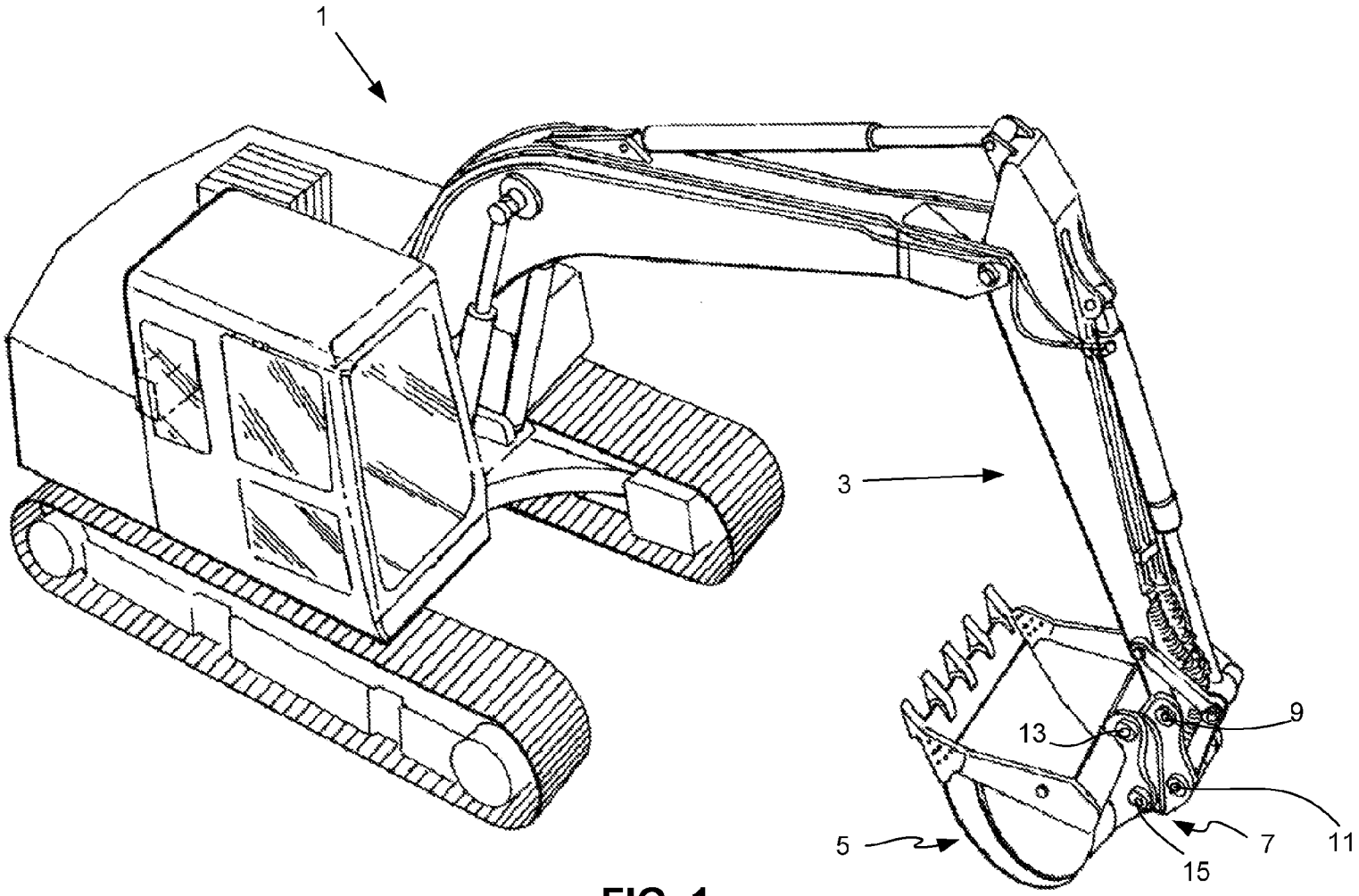
FIG. 1 (Prior Art)
FIG. 1 depicts a prior art excavation machine with a prior art quick coupler connecting a digger arm of the machine to an attachment in the form of a bucket.
Figure 2:
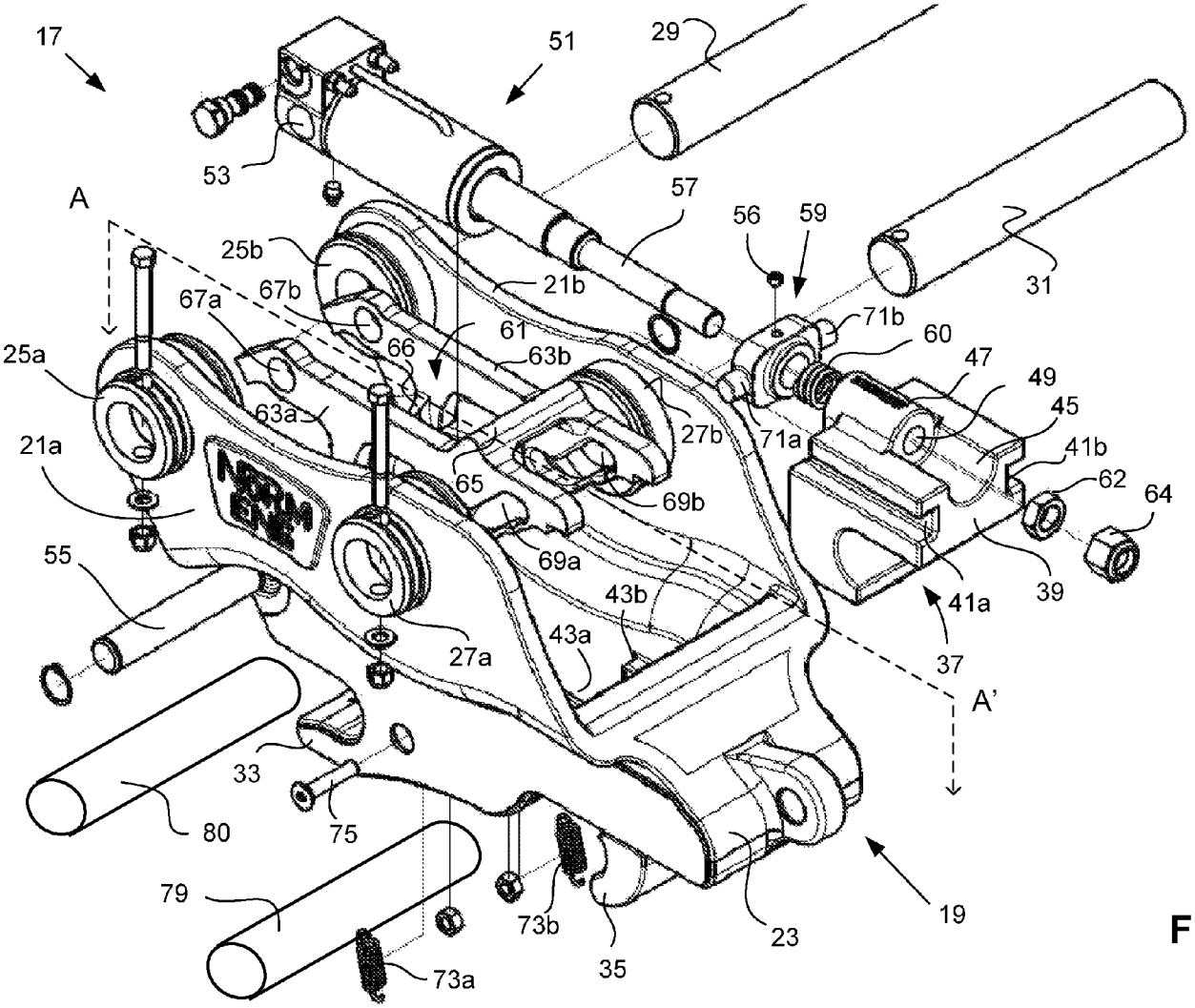
FIG. 2 is an exploded view of a quick coupler according to a preferred embodiment of the present invention.

Referring now to FIG. 2 there is depicted an exploded view of a quick coupler 17 according to a preferred embodiment of the present invention. The quick coupler 17 has a body 19 which includes first and second side walls 21*a*, 21*b* interconnected by a transverse spacer 23.

The side walls 21*a*, 21*b* are formed with respective pairs of forward bushed bores 25*a*, 25*b* and rear bushed bores 27*a*, 27*b*. The forward bushed bores 25*a*, 25*b* receive forward dipper coupling pin 29 and similarly the rear bushed bores 27*a*, 27*b* receive rear dipper coupling pin 31, for fastening the quick coupler to a machine, for example the dipper arm of an earth moving machine.

Forwardly, the underside of the body 19 is formed with a first fixed jaw 33 for engagement with a first coupling pin 80 of an attachment. The attachment may be a bucket for example but it could also be any one of a variety of other attachments such as a hydraulic hammer or a chisel.

Between the first and second side walls 21*a* and 21*b* there is located a movable jaw 37 which is formed with an upper jaw body portion 39. Jaw body 39 is formed with opposed slots 41*a*, 41*b* which receive corresponding opposed rails 43*a*, 43*b* which extend inwardly from the sidewalls 21*a* and 21*b* of coupler body 19. Accordingly the moveable jaw 37, which faces rearwardly, is able to slide toward the second attachment pin 79 along the opposed rails 41*a*, 41*b* to a closed position wherein it abuts the pin 79

The upper surface of jaw body 39 is formed with a concave cradle 45. Forward of the cradle the movable jaw body 39 is formed with a ram rod retainer 47. The ram rod retain 47 comprises a cylindrical body having an axial bore 49 therethrough. An actuator in the form of a hydraulic ram 51 is located between the side walls 21*a*, 21*b*.

A forward end of the hydraulic ram 51 is formed with a transverse bore 53 therethrough. A ram retaining pin 55 traverses the side walls 21*a*, 21*b* and the bore 53 thereby retaining the hydraulic ram 51. The hydraulic ram 51 has a rearwardly extending ram rod 57. The ram rod 57 extends through locking collar 59, movable jaw spring 60 and thence through the axial bore 49 of ram rod retainer 47. The ram rod 57 has a threaded tip which is secured by jam nut 62 and locking nut 64, both of which locate within cradle 45 of jaw body 39. A grub screw 56 penetrates through a top wall of the locking collar 59 and acts to hold the locking collar fast with the ram rod 57.

Accordingly, operation of the hydraulic ram 51 causes the locking collar 59 to move with the ram rod 57. As will be explained, the ram rod 57 also acts to push and pull the movable jaw body 39 and hence jaw 37 so that it slides on rails 43*a*, 43*b* into and out of engagement with the second attachment coupling pin 79.

Also located between side walls 21*a* and 21*b* of the coupler 17 is a locking arm 61. The locking arm 61 is comprised of a pair of parallel locking arm members 63*a*, 63*b* which are rigidly interconnected and spaced apart by integral transverse bridging portions 65, 66. The hydraulic ram 51 locates in a space between the locking arm members 63*a*, 63*b*.

Toward a forward end of each locking arm member a pivot hole 67*a*, 67*b* is formed therethrough. The ram retaining pin 55 also penetrates through the locking arm member pivot holes 67*a*, 67*b*. Accordingly, the hydraulic ram 51 and the locking arm 61 are both retained at their forward end by the ram retaining pin 55.

The locking arm members 63*a*, 63*b* of the locking arm are formed with closed cam follower slots 69*a*, 69*b* which respectively receive transversely extending trunnions 71*a* and 71*b* of the locking collar 59. The trunnions 71*a* and 71*b* effectively act as translation cams for the cam follower slots 69*a*, 69*b*.

Figure 3:
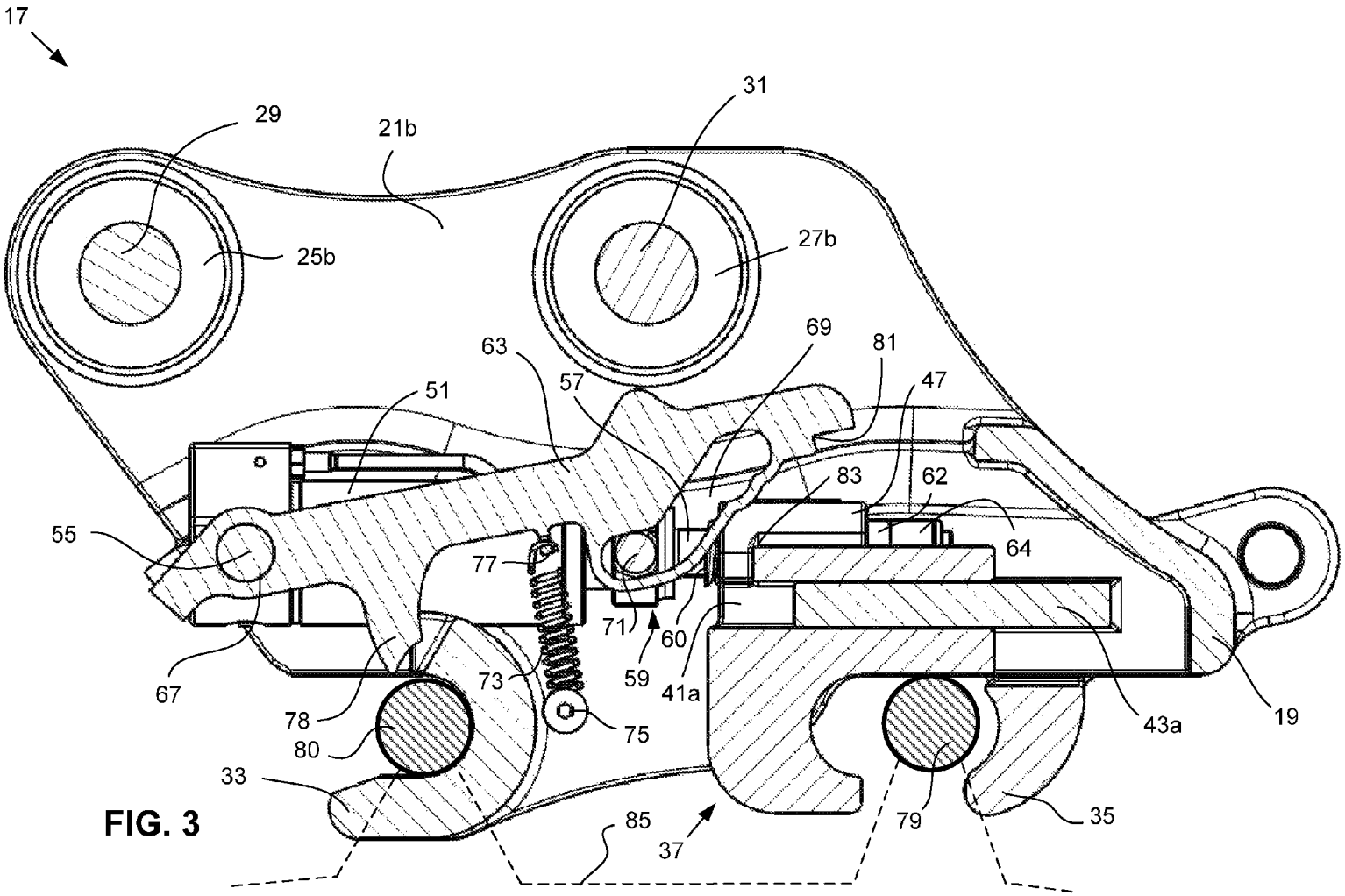
FIG. 3 is a cross sectional view of the quick coupler of FIG. 2 in an unlocked configuration.

FIG. 3 is a cross sectional view of the quick coupler 17 through section A-A' as indicated in FIG. 2. The section A-A' is through first locking arm member 63*a*. Since locking arm members 63*a* and 63*b* are identical it is to be understood that the following description, which is made with reference to FIG. 3, also holds true for locking arm member 63*b*. For convenience the features of the locking arm members will be generally referred to by a single identifier number, for example it will be understood that "pivot hole 67" is to be understood as a shorthand for "pivot hole 67*a* and pivot hole 67*b*".

With reference to FIG. 3, a biasing means in the form of locking arm member coil spring 73 is fastened under tension between spring detent bolt 75 and spring retaining formation 77 of locking arm member 63. The spring detent bolt 75 is fastened to a side 21 of the body 19 of the coupler 17. Accordingly, the coil spring 73 urges the locking arm member 63 to pivot clockwise about the ram retaining pin 55. The biasing force of the coil spring 73 is offset by the action of the trunnion 71 against an upper edge of the closed cam follower slot 69 when the ram rod 57 is retracted as shown in FIG. 3.

The underside of the locking arm member 63 is fast with a latch 78 that extends downward from the locking arm member 63 and which is integrally formed therewith.

Upon the hydraulic actuator 51 being operated, the ram rod 57 extends pushing the locking collar 59 into contact with a resilient spacer in the form of movable jaw spring 60. As the ram rod 57 continues to extend the spring 60 then urges the jaw body 39 along rails 43*a*, 43*b* so that the movable jaw 37 advances towards the second fixed jaw 35.

Figure 4:
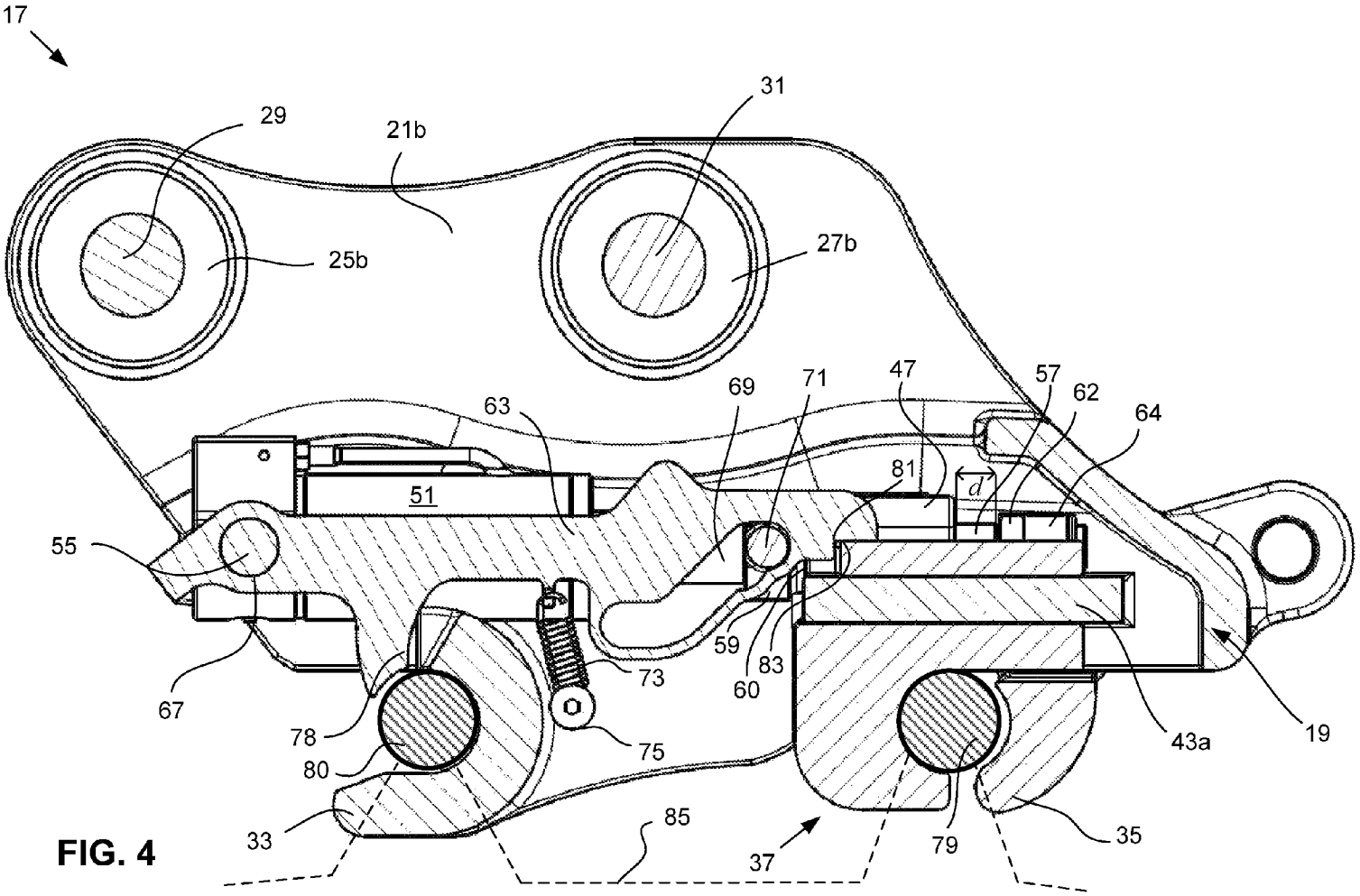
FIG. 4 is a cross sectional view of the quick coupler of FIG. 2 in a locked configuration.

The movable jaw 37 continues to advance until, as shown in FIG. 4, it assumes a closed position wherein it abuts the second coupling pin 79 of the attachment. In this closed position the movable jaw 37 cooperates with the second fixed jaw 35 to retain the second coupling pin 79 therebetween.

As the ram rod 57 extends from the position shown in FIG. 3 to the position shown in FIG. 4, it brings with it the locking collar 59 as previously explained. Consequently, trunnion 71 forces against the walls of the closed cam follower slot 69. As the trunnion 71 proceeds within the cam follower slot 69 it urges the arm 63 to pivot clockwise about the ram retaining pin 55 and is assisted by the locking arm member spring 73. A forward portion of the locking arm member 63 is formed with an angled cutaway 81 that has sides which complement a corner 83 of the movable jaw body 39. As the locking arm member 63 pivots clockwise about the ram retaining pin 55 the movable jaw body advances so that the position of the corner 83 corresponds to that of the angled cutaway 81. The locking collar 59 then compresses the movable jaw spring 60 thereby allowing the trunnion 71 to progress a little further in cam follower slot 69 so that it reaches a final station in the slot 69. The final station in the slot 69 has a flat upper edge thereby preventing the locking arm member 63 from pivoting back up should the trunnion 71 move slightly, either back or forth. Consequently, in the state shown in FIG. 4 the locking arm member 63 has assumed a locked position wherein it prevents withdrawal of the movable jaw 37 from its closed position. In the closed position shown in FIG. 4 the movable jaw 37 abuts and retains the second attachment pin 79.

As the locking arm member 63 pivots clockwise about the ram retaining pin 55 from the unlocked configuration shown in FIG. 3 to the locked configuration of FIG. 4, the latch 78 descends so that it cooperates with the first fixed jaw 33 to thereby retain the first attachment coupling pin 80.

It will be noted that the latch 78 assumes the latched position shown in FIG. 4 as the locking arm member 63 locks the movable jaw 39 to the closed position.

Although a pivoting locking arm 61 is preferred, the locking arm could, in other embodiments of the invention slide downward from an unlocked to a locked position. However, such an arrangement may involve a second hydraulic actuator which is less than desirable.

In order to unlock the quick coupler 17 from the first and second attachment coupling pins hydraulic pressure is initially applied to the hydraulic ram 51 in a direction to cause the ram rod 57 to retract from its extended, locked, position.

The rod 57 slides forward through the ram rod retainer 47, which is fast with the movable jaw body 39. With retraction of the rod 57 the locking collar 59 and hence trunnion 71 move forward. As the trunnion 71 moves forward it acts as a translation cam against the closed cam follower slot 69 and so causes the locking arm member 63 to overcome the locking arm member spring 73 and to pivot counterclockwise about ram retaining pin 55. As the locking arm member 63 pivots counterclockwise the angled cutaway 81 comes clear of corner 83 of the movable jaw body 39. Consequently the locking arm member 63 no longer prevents sliding of the movable jaw body 39.

Initial retraction of the rod 57 does not move the movable jaw body 39 since in its extended position there is a length "d" of the rod 57 between retainer 47 and the jam nut 62. After the ram rod 57 has been retracted through the distance "d" the jam nut 62 comes into contact with the rear of retainer 47 so that the movable jaw body 39 commences to slide forward thereby bringing the movable jaw 37 away from abutment with the second attachment coupling pin 79 and thereby out of the closed position. Consequently the second attachment coupling pin 79 is now longer locked in place. Simultaneously the locking collar 59, which is fast with the ram rod 57 by virtue of grub screw 56, continues to move forward, so that its trunnion 71 continues to act against the closed cam follower slot 69 and pivots the locking arm member 63 anticlockwise. As the locking arm member 63 continues to pivot to the final position shown in FIG. 3 the latch 79 clears the first fixed jaw and so the first attachment coupling pin 80 is no longer locked in place.

It will be realized that once in the locked position, that is shown in FIG. 4, the coupler will maintain locking of both the first and second attachment coupler pins 80, 79 even if the hydraulic ram 51 fails or if there is a failure in the hydraulic circuit that powers the hydraulic ram. This is because the locking arm members 63*a*, 63*b* of the locking arm 61 simultaneously lock both the first attachment coupling pin, by means of latch 78, and the second attachment coupling pin, by means of the angled cutaway 81 engaging the corner 83 of the movable jaw body 69.

Figure 5:
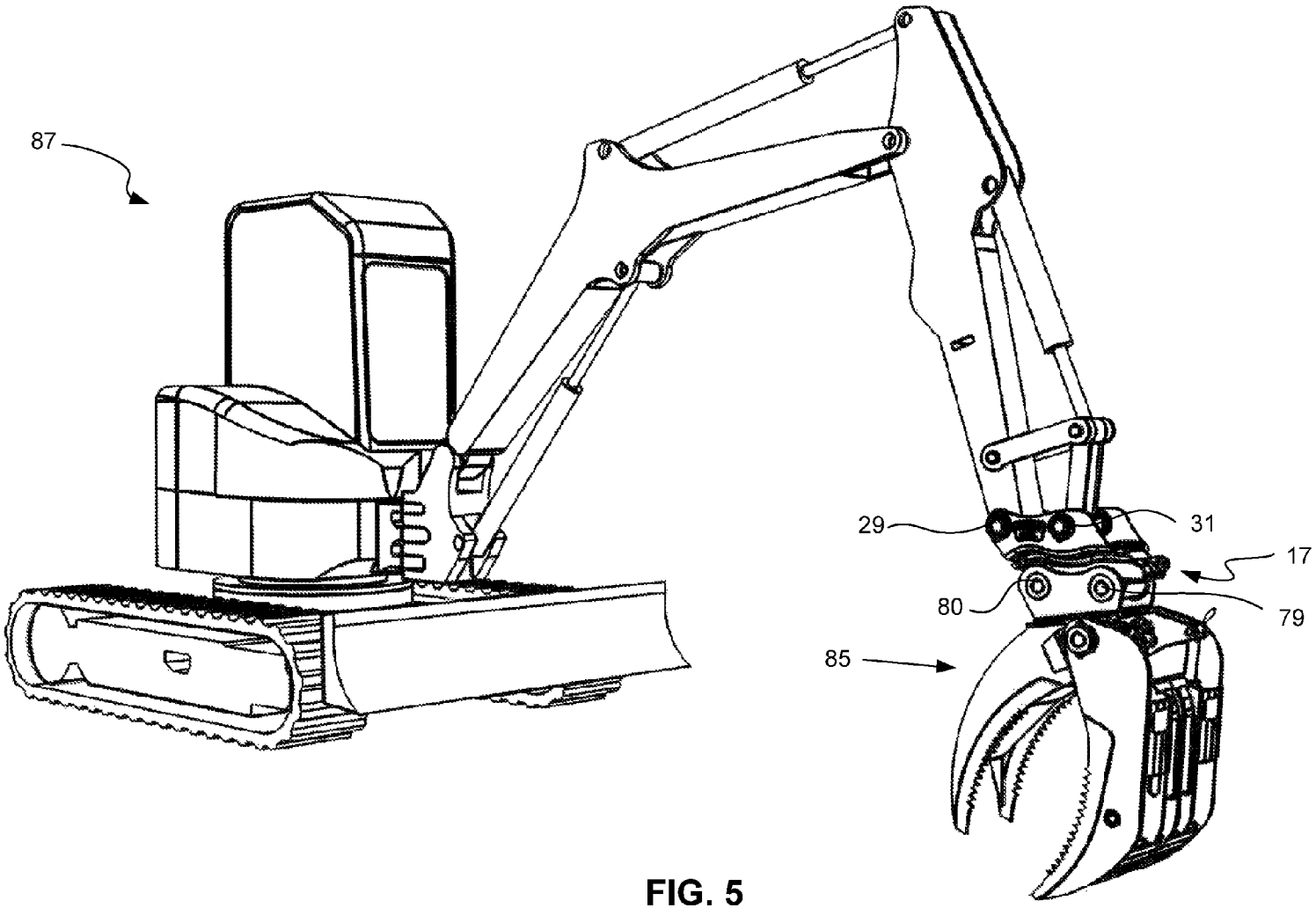
FIG. 5 depicts the quick coupler of FIG. 2 in use.

FIG. 5 shows the coupler 17 in use coupling an attachment, in the form of a hydraulic rock grab 85, to the dipper arm of an excavator 87.

Figure 6:
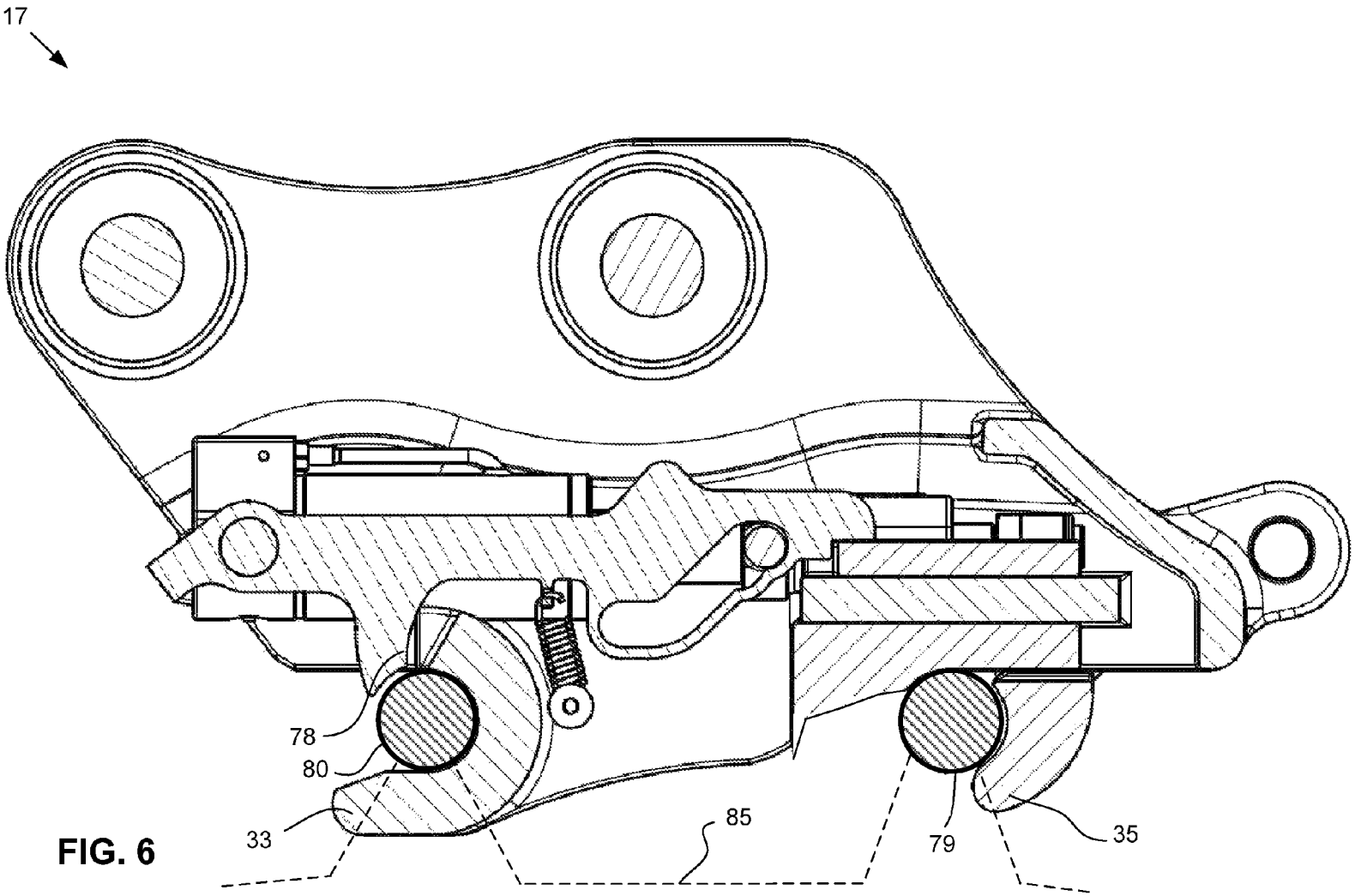
FIG. 6 is a cross sectional view of the quick coupler of FIG. 2 illustrating the operation of the quick coupler during a partial mechanical failure; and, FIG. 7 depicts tilting quick coupler according to a further embodiment of the present invention.

Once the coupler 17 is in in the locked configuration of FIG. 4 then even if movable jaw 37 fractures and falls away as shown in FIG. 6, the second fixed jaw 35 prevents pivoting of the coupler 17 and attachment about the first attachment coupling pin 80. Furthermore, the second fixed jaw 35 cooperates with latch 78 and first fixed jaw 33 to retain the attachment coupling pins 80, 79 and so also the attachment 85 so that the attachment does not drop or swing.

Figure 7:
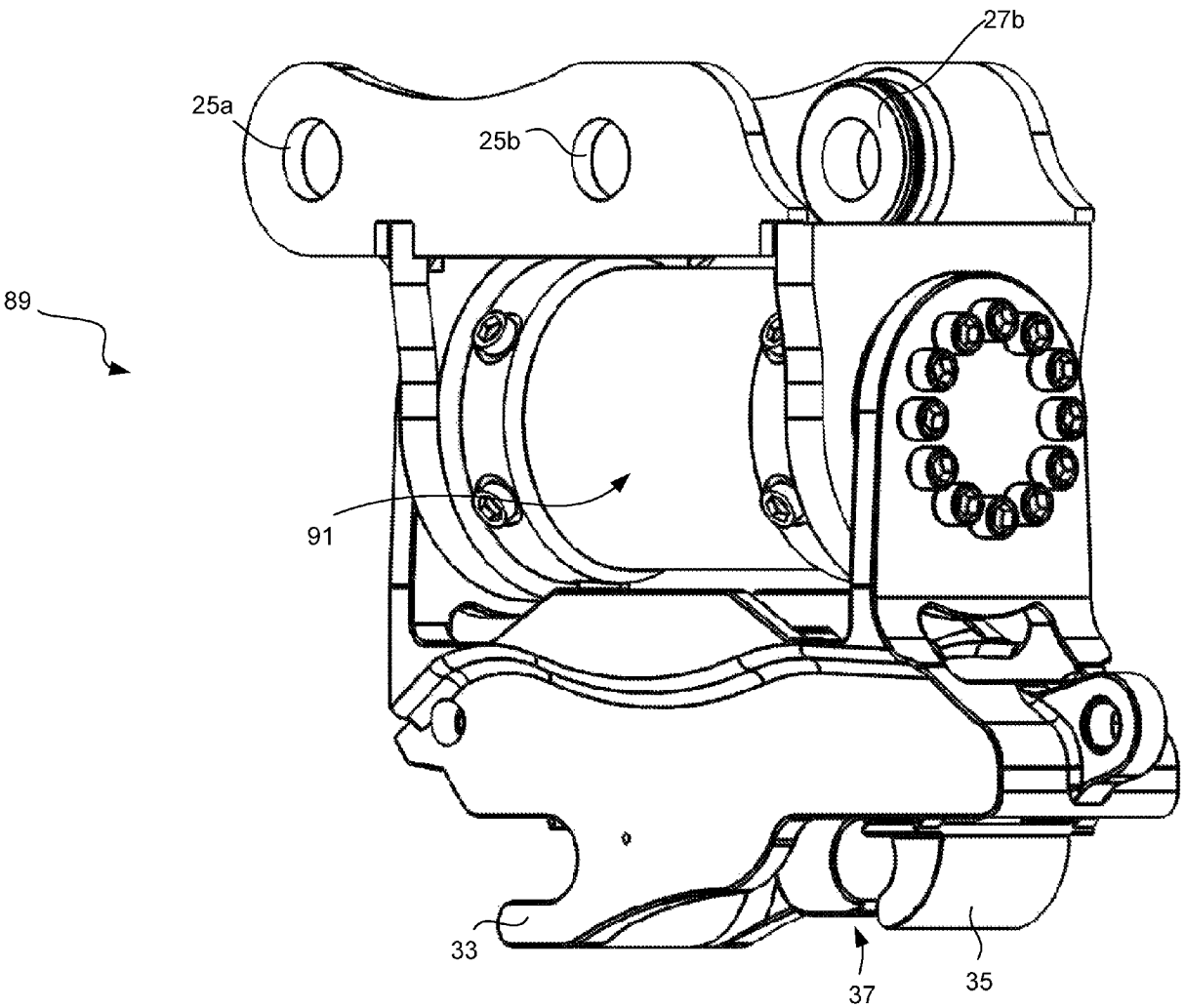

FIG. 7 shows a coupler 89 which comprises a further embodiment of the present invention. The coupler 89 has an identical mechanism to the coupler 17 that has previously been described save that coupler 89 includes a hydraulic rotary actuator 91. The hydraulic tilt barrel provides for tilting between coupling points in the form of the bushed bores 25, 27 that receive the forward and rear dipper coupler pins and the jaws 33 and 37 that project from the underside of the coupler. Consequently an operator of the excavation machine to which the coupler 89 is installed is able to tilt the attachment by operating the hydraulic rotary actuator 91.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

We claim:

1. A quick coupler for coupling an attachment to a machine, the attachment having first and second coupling pins, the quick coupler comprising:

a first fixed jaw for the first coupling pin;

a moveable jaw moveable to a closed position for retaining the second coupling pin;

a locking arm arranged to assume a locked position in which the arm prevents withdrawal of the moveable jaw from the closed position, the locking arm including a closed cam follower;

a latch cooperating with the first fixed jaw and moveable to a latched position for retaining the first coupling pin the latch being fast with the locking arm and arranged to assume the latched position upon the locking arm assuming the locked position;

an actuator arranged to move the movable jaw; and, a translation cam coupled to the actuator, the closed cam follower arranged to follow the translation cam thereby coupling the actuator to the locking arm;

whereby operation of the actuator brings the jaw to the closed position and the arm to the locked position, thereby preventing withdrawal of the jaw from the closed position, while also bringing the latch to the latched position.

2. The quick coupler according to claim 1, wherein the locking arm is pivoted at one end for pivoting to the locked position.

3. The quick coupler according to claim 1, wherein the locking arm and the movable jaw have complementary engagement formations which engage upon the locking arm assuming the locked position and the movable jaw assuming the closed position.

4. The quick coupler according to claim 3, wherein the complementary engagement formations comprise an angled cutout of the locking arm and a complementary corner of the movable jaw.

5. The quick coupler according to claim 1, further comprising a biasing means to bias the locking arm to the locked position.

6. The quick coupler according to claim 1, wherein the translation cam comprises a trunnion.

7. The quick coupler according to claim 6, wherein the actuator comprises a linear actuator and wherein the trunnion is coupled to a shaft of the linear actuator.

8. The quick coupler according to claim 7, wherein the linear actuator comprises a hydraulic ram.

9. The quick coupler according to claim 8, wherein the trunnion comprises a portion of a locking collar.

10. The quick coupler according to claim 9, wherein the movable jaw slides on guides formed on inner sides of a body of the quick coupler.

11. The quick coupler according to claim 10, wherein the movable jaw is moved to the closed position by means of the linear actuator.

12. The quick coupler according to 1, wherein a resilient spacer is located between the translation cam and the movable jaw whereby upon the movable jaw reaching the closed position the resilient spacer is compressed to thereby allow the translation cam to progress in the closed cam follower to thereby bring the locking arm to the locked position.

13. The quick coupler according to claim 12, wherein the resilient spacer comprises a coil spring.

14. The quick coupler according to claim 1, including a second fixed jaw positioned to engage the second attachment coupling pin upon failure of the movable jaw while the first attachment coupling pin is retained by the latch and the first fixed jaw to thereby prevent swinging of the attachment.

15. The quick coupler according to claim 14 wherein the second fixed jaw opposes the movable jaw.

16. The quick coupler according to claim 1, including a rotary actuator disposed between coupling points of the coupler for attachment to the machine and the first fixed jaw and the movable jaw whereby operation of the rotary actuator tilts the jaws relative to the coupling points.

* * * * *